US007543347B2

(12) United States Patent
Green

(10) Patent No.: US 7,543,347 B2
(45) Date of Patent: Jun. 9, 2009

(54) MOBILE BRIDGE SYSTEM

(75) Inventor: Volker Green, Borgstedt (DE)

(73) Assignee: I.C.I. Inter-Commerz Innovationstechnik GmbH, Borgstedt (DE)

( * ) Notice: Subject to any disclaimer, the term of this patent is extended or adjusted under 35 U.S.C. 154(b) by 0 days.

(21) Appl. No.: 11/795,760

(22) PCT Filed: Dec. 8, 2005

(86) PCT No.: PCT/DE2005/002211

§ 371 (c)(1),
(2), (4) Date: Jul. 20, 2007

(87) PCT Pub. No.: WO2006/076874

PCT Pub. Date: Jul. 27, 2006

(65) Prior Publication Data

US 2008/0163439 A1 Jul. 10, 2008

(30) Foreign Application Priority Data

Jan. 22, 2005 (DE) ..... 10 2005 003 044

(51) Int. Cl.
*E01D 15/12* (2006.01)

(52) U.S. Cl. ..... 14/2.4; 14/2.5

(58) Field of Classification Search ..... 14/2.4, 14/2.5

See application file for complete search history.

(56) References Cited

U.S. PATENT DOCUMENTS 2,556,175 A * 6/1951 Frost ..... 14/2.4
3,820,181 A * 6/1974 Wagner et al. ..... 14/2.5
3,845,514 A * 11/1974 Wagner ..... 14/2.4
3,871,045 A * 3/1975 Bouvet et al. ..... 14/2.4
4,033,006 A * 7/1977 Soffge et al. ..... 14/75
4,062,081 A * 12/1977 Ramer ..... 14/2.4
4,411,036 A 10/1983 Fitzgerald-Smith
4,493,122 A * 1/1985 Echtler et al. ..... 14/2.4
4,510,637 A * 4/1985 Zlotnicki ..... 14/2.4
4,521,932 A * 6/1985 Parramore ..... 14/2.5
4,534,079 A * 8/1985 Tucker ..... 14/14
4,602,399 A * 7/1986 Jenkins ..... 14/2.4
5,385,219 A * 1/1995 Snell ..... 14/2.5
5,617,598 A * 4/1997 Kinzel et al. ..... 14/2.4

FOREIGN PATENT DOCUMENTS

DE 21 66 758 A1 11/1981
DE 31 45 582 A1 8/1982

* cited by examiner

*Primary Examiner*—Raymond W Addie
(74) *Attorney, Agent, or Firm*—Diederiks & Whitelaw, PLC

(57) ABSTRACT

Mobile bridge system with at least one bridge section comprising two articulatedly interconnected parts, and a bridge laying vehicle provided with a lifting frame hydraulically pivotable from the horizontal transportation position into a vertical laying position, carrying a lowering frame guiding a laying cable and pivotably resting on the vehicle. One part of the bridge section, during the transportation thereof, rests a downwardly directed roadway surface on the lifting frame and is locked thereto, while the other part of the bridge section during the transportation thereof rests with an upwardly directed roadway surface on the first part. A lowering frame is fixed to the lifting frame so as to be displaceable beyond its free end and the other part of the bridge section is provided in the vicinity of its free end with outwardly pivotably mounted, length-adjustable trestle legs.

10 Claims, 5 Drawing Sheets

MOBILE BRIDGE SYSTEM

CROSS-REFERENCE TO RELATED APPLICATIONS

This application claims the benefit of International Application No. PCT/DE2005/002211 filed Dec. 8, 2005, pending.

BACKGROUND OF THE INVENTION

The invention relates to a mobile bridge system with at least one bridge section comprising two articulatedly interconnected parts, and a bridge laying vehicle provided with a lifting frame pivotably resting thereon, carrying a lowering frame guiding a laying cable and hydraulically pivotable from the horizontal transportation position into a vertical laying position, one part of the bridge section during the transportation thereof resting with downwardly directed roadway surface locked to and resting on the lifting frame. Such a mobile bridge system is known from DE 31 45 582 A1.

The known mobile bridge system suffers from the disadvantage that it is unsuitable for erecting a link bridge, i.e. a mobile bridge comprising several bridge sections. It is also disadvantageous that the bridge section length is only slightly longer than the bridge laying vehicle loading surface and several bridge sections cannot be placed on one another.

Therefore the problem of the invention is to provide a mobile bridge system enabling the erection of a bridge comprising several sections, each section being significantly longer than the loading surface of the bridge laying vehicle.

SUMMARY OF THE INVENTION

The invention solves this problem in that the other part of the bridge section during the transportation thereof rests with upwardly directed roadways surface on one part, the lowering frame being displaceably fixed to and beyond the free end of the lifting frame and the other part of the bridge section is provided in the vicinity of its free end with outwardly pivotably mounted, length-adjustable trestle legs.

The bridge laying vehicle is to be provided with a vehicle support fixed to its rear end. The two parts are to have an identical construction, so that it is possible for the bridge laying vehicle to take up the bridge on the other bank of the watercourse to be bridged.

The invention also relates to a method for laying a mobile bridge of a mobile bridge system having the following method steps:

- moving up to the location where one end of the part of the bridge section is to be located,
- extending the vehicle support of the bridge laying vehicle,
- pivoting out the lifting frame together with the two parts of the bridge section carried by it out of the horizontal by more than 90°,
- drawing up the laying cable secured close to the free end of the other part into a position aligned with the first part,
- unlocking the upper end of the first part from the lifting frame,
- pivoting out the extended bridge section after lowering the laying cable accompanied by the pivoting of the first part about the lower end of the lifting frame,
- adjusting the length of the trestle legs,
- further pivoting out of the bridge section and the placing thereof on the trestle legs,
- lowering the lifting frame articulatedly connected to the proximal end of one part of the bridge section and optionally passing the distal end of the first part into the bracing tube of the trestle legs of the other part of a previously laid bridge section and
- releasing the proximal end of the first part from the lifting frame.

BRIEF DESCRIPTION OF THE DRAWINGS

The invention is explained hereinafter relative to the drawings showing the different stages of laying the mobile bridge in side view as follows.

DETAILED DESCRIPTION OF THE PREFERRED EMBODIMENT

Figure 1:
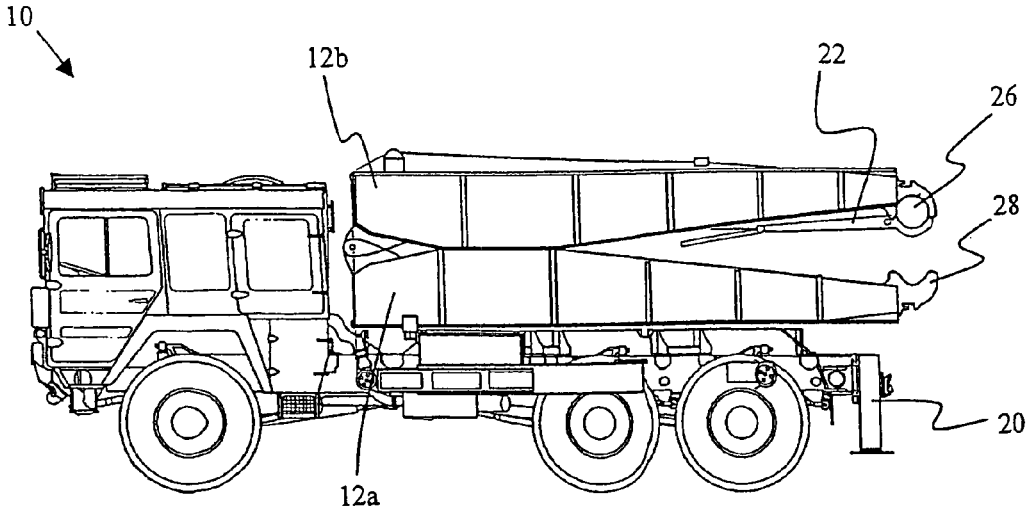
FIG. 1 shows a bridge laying vehicle constructed according to a preferred embodiment of the invention.

FIG. 1 shows the bridge laying vehicle 10 with the bridge section comprising two articulatedly connected parts 12*a*, 12*b* resting thereon. The two parts 12*a*, 12*b* rest on a lifting frame 18, which can be hydraulically pivoted from the horizontal transportation position into a vertical laying position. The lifting frame 18 also carries a lowering frame 16 shoved into the transportation position shown in FIG. 1.

In the transportation position a first part 12*a* of bridge section 12 rests with downwardly directed roadway surface on lifting frame 18 being twice locked thereto, whilst the other part 12*b* of bridge section 12 in the transportation position rests on the first part 12*a* with upwardly directed roadway surface.

The other part carries on its surface opposite to the roadway surface length-adjustable trestle legs pivotable to the other part 12*b*, which has a winch for adjusting the trestle leg length.

At its rear end the bridge laying vehicle 10 is provided with a pair of vehicle supports 20, which are only shown in FIG. 1 so as not to overburden representation.

The two parts 12*a*, 12*b* have an identical construction, but only the other part is provided with trestle legs.

Figure 2:
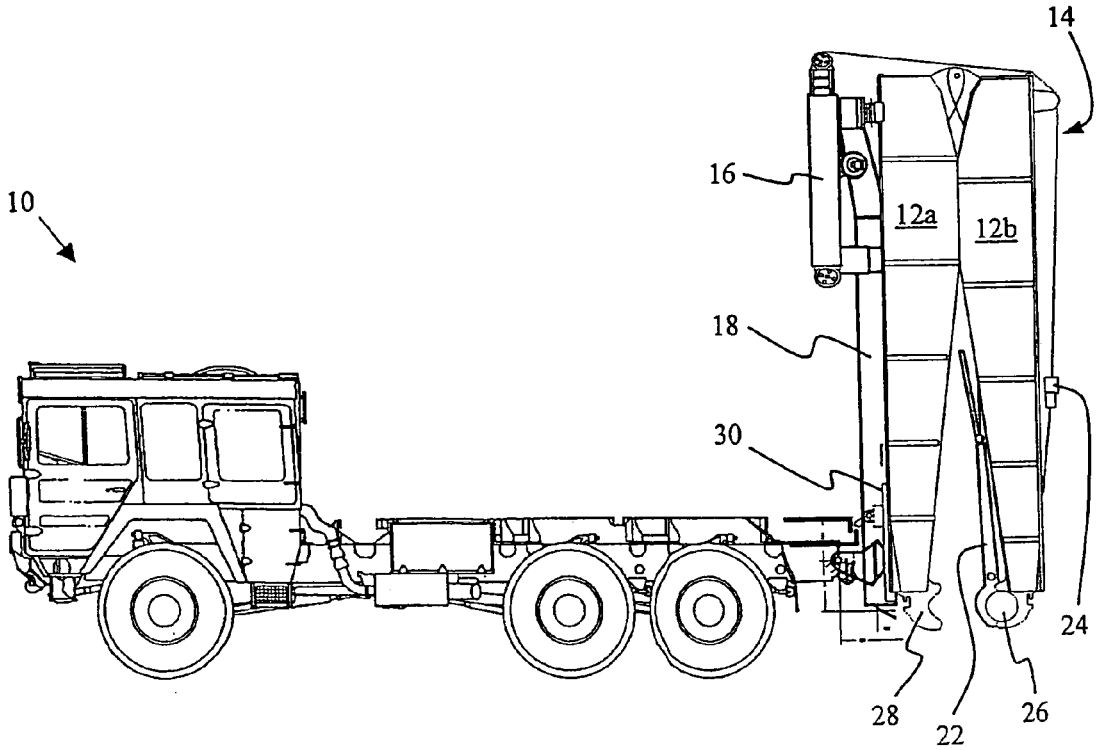
FIG. 2 shows two parts of a bridge section being carried by the vehicle of FIG. 1 and shifted to a vertical position.
Figure 3:
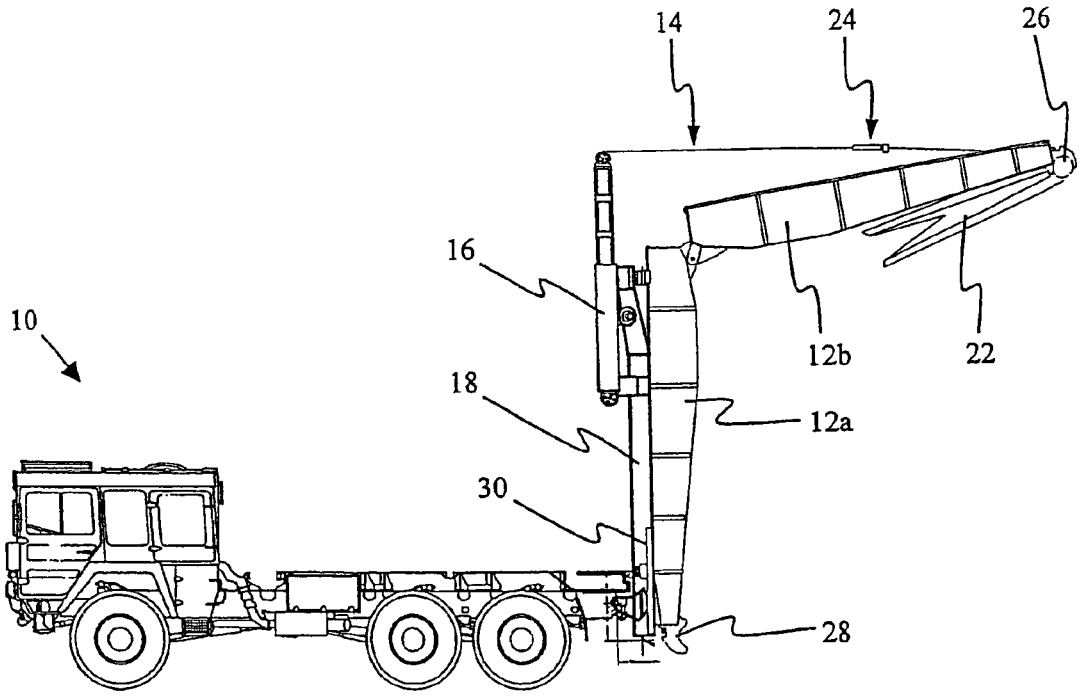
FIG. 3 illustrates one of the bridge section parts of FIG. 2 being articulated relative to the other bridge section part.

FIG. 2 shows how the two bridge section parts 12*a*, 12*b* can be hydraulically pivoted up into the vertical position by pivoting up lifting frame 18. FIG. 3 shows the stage in which the other part 12*b* articulatedly connected to the first part 12*a* is drawn up by means of a laying cable 14 over the lowering frame 16 extended from the lifting frame 18, said cable being fixed in the vicinity of the free end of the other part. The laying cable is guided by means of an only intimated roll-equipped crossbar 24, which ensures a load compensation.

Figure 4:
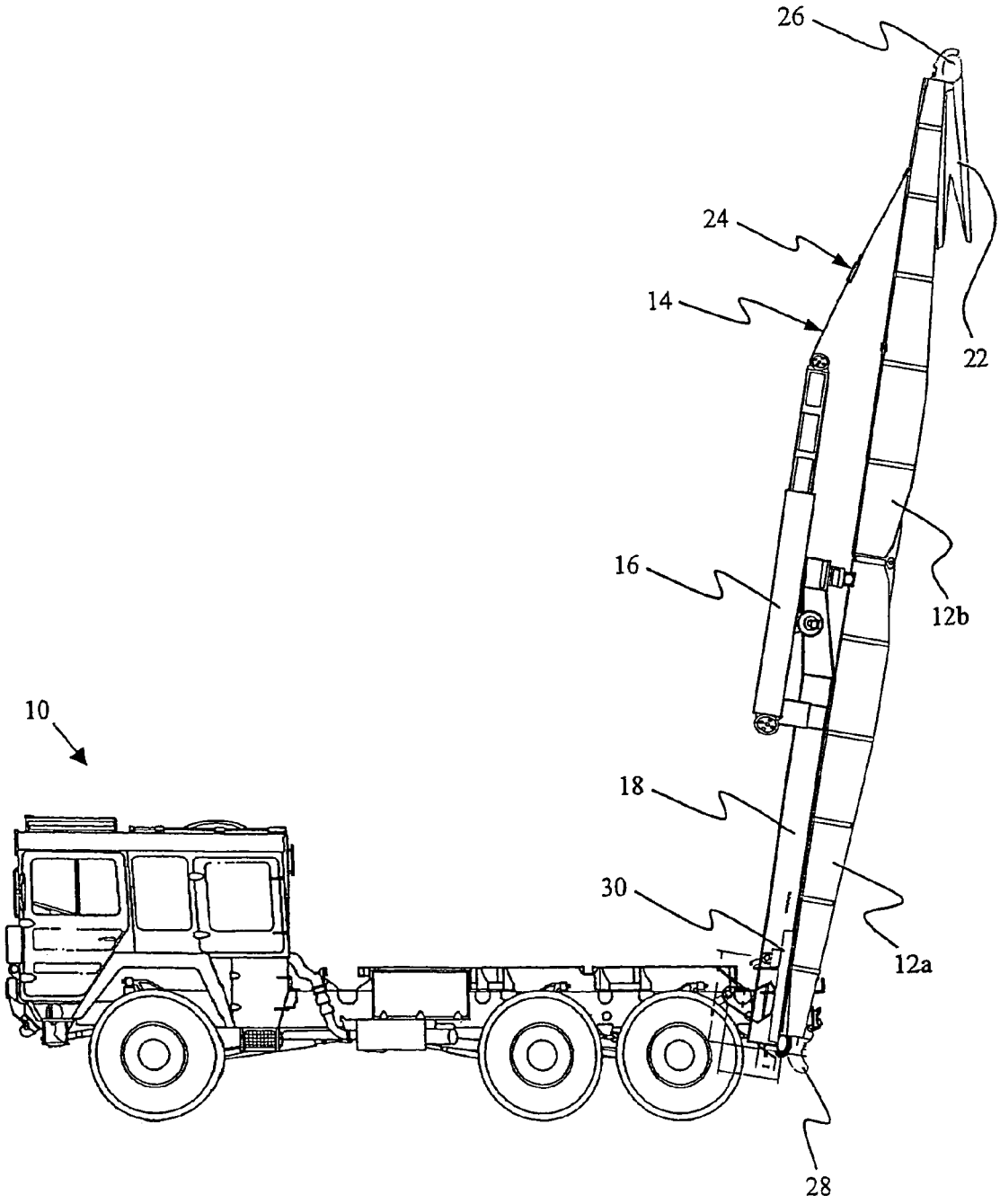
FIG. 4 shows the bridge section in a fully extended condition.
Figure 5:
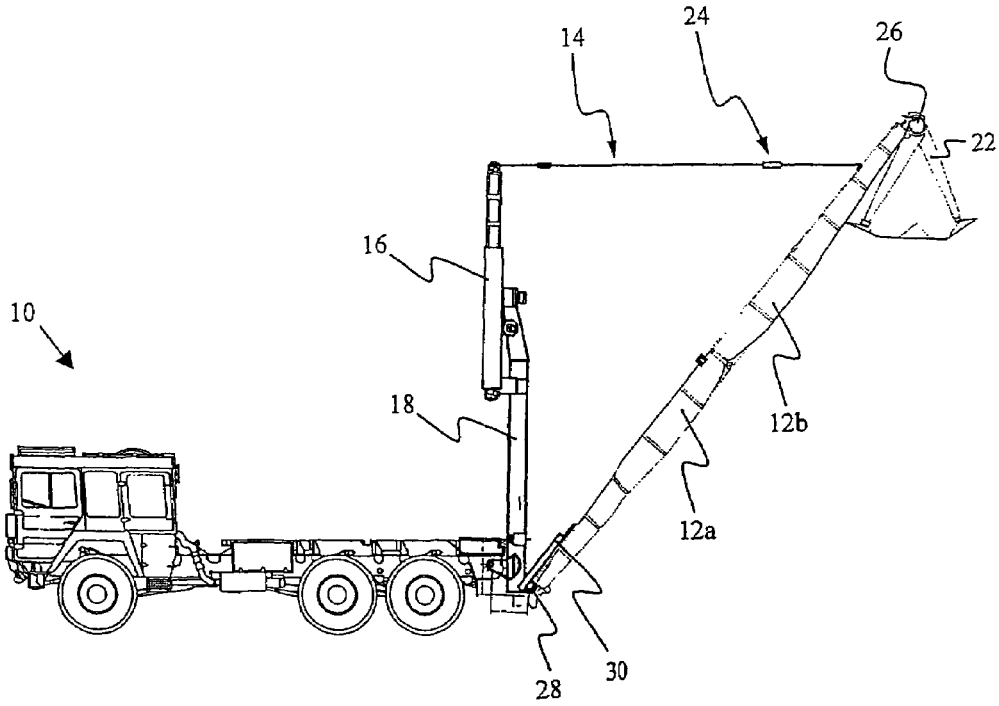
FIG. 5 shows the bridge section of FIG. 4 being partially lowered.

In FIG. 4 the bridge section is fully extended, lifting frame 18 assuming an angle of more than 90Ø to the loading surface of bridge laying vehicle 10. Bridge section is lowered (after releasing first part 12*a* from lifting frame 18) on drawing off laying cable 14 away from vehicle 10 (FIG. 5) until the position shown in FIG. 6 is reached.

In this position the length of the trestle legs 22 provided with a bracing tube 26 articulatedly locked to the other part 12*a* by claws 28 is so adjusted by means of a not shown trestle leg winch in the vicinity of the distal end of the other part 12*b* that on reaching the bottom of the watercourse to be bridged a horizontal course of the roadway is ensured. The bridge section is then pivoted down further until the trestle legs reach the bottom of the watercourse.

Figure 6:
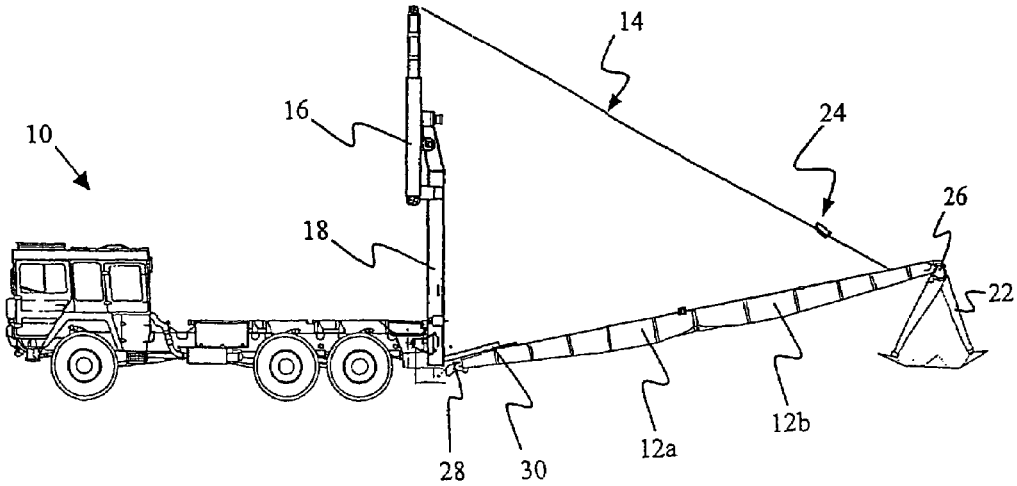
FIG. 6 shows the bridge section of FIG. 5 being further lowered.
Figure 7:
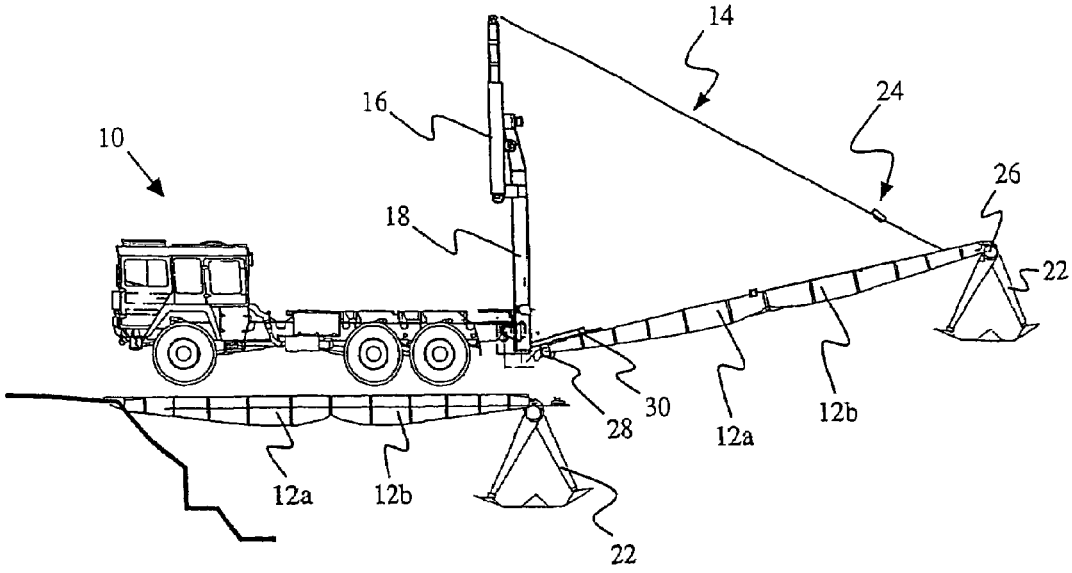
FIG. 7 shows the laying of a further bridge section.

FIG. 6 shows the laying of a first bridge section in which its distal end is laid on the bank. FIG. 7 shows the laying of a further bridge section, where the bridge laying vehicle is standing rearwards on an already laid bridge section and lays on and extends the latter by a further bridge section.

Figure 8:
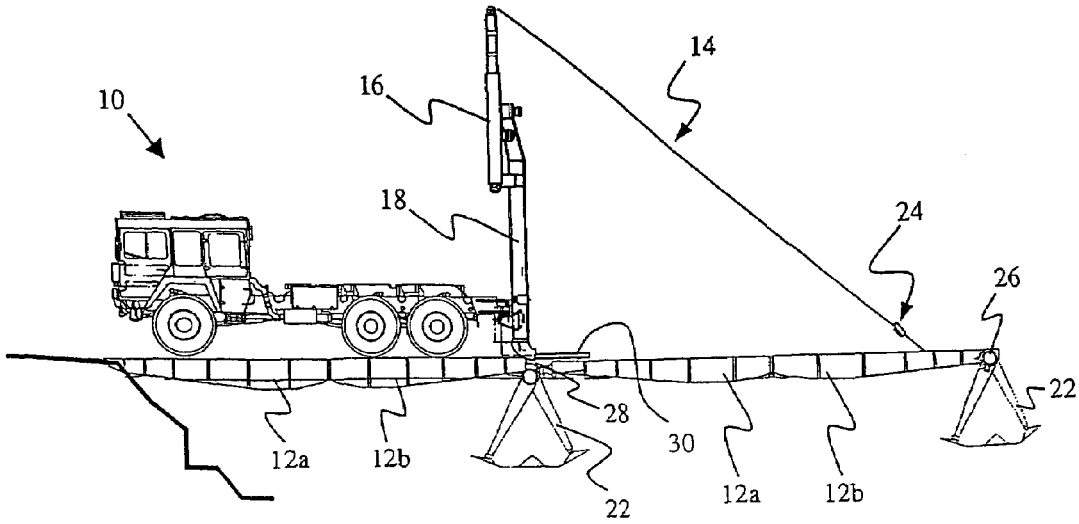
FIG. 8 illustrates the lowering of a lifting frame of the bridge laying vehicle.

FIG. 8 shows the lowering of lifting frame 18 by a device 30 carrying the lifting frame 18, the claws 28 of the proximal end of the part 12*a*, i.e. that pointing towards the bridge laying vehicle, is passed into the bracing tube 26 of the trestle legs 22 of a previously laid bridge section 12*a*, 12*b* and is locked thereto, the claws 28 on a first part 12*a* being displaced relative to the other bridge section part 12*b*. It is obvious that this does not occur with the first bridge section to be laid (FIG. 6). The proximal end of the first part 12*a* is then released from the lifting frame 18 and the bridge laying vehicle is moved away.

The taking up of the bridge section occurs in corresponding reverse order, the trestle legs on whose bracing tube the other part of the last laid bridge section is deposited remains locked thereto and the locking thereof with the other part of the previously laid bridge section is released.

The adjustability of the spacing of the roadways forming parts 12*a*, 12*b* is not shown in the drawings.

The invention claimed is:

1. A mobile bridge system comprising:

a bridge laying vehicle;

a lifting frame pivotably mounted to the bridge laying vehicle for movement between a lowered, substantially horizontal transportation position, wherein the lifting frame rests on part of the bridge laying vehicle, and a raised laying position;

a bridge section including first and second articulatedly interconnected bridge parts defining respective first and second roadway surfaces wherein, when the lifting frame is in the transportation position, the first roadway surface of the first bridge part rests on the lifting frame and the second bridge part is positioned upon the first bridge part with one end of the second bridge part being articulatedly interconnected to the first bridge part, an opposing end of the second bridge part defining a free end portion and the second roadway surface being upwardly exposed;

a lowering frame displaceably fixed to the lifting frame, said lowering frame having a free end which extends over and beyond the lifting frame; and a plurality of length-adjustable trestle legs pivotally mounted at the free end portion of the second bridge part.

2. The mobile bridge system according to claim 1, further comprising: a laying cable attached to the lowering frame and detachably secured to the second bridge part.

3. The mobile bridge system according to claim 2, wherein the lifting frame extends substantially vertically in the raised laying position, with the laying cable projecting above the lifting frame.

4. The mobile bridge system according to claim 1, further comprising: a vehicle support fixed to a rear end of the bridge laying vehicle.

5. The mobile bridge system according to claim 1, wherein the first and second bridge pails are identically constructed.

6. A method of laying a mobile bridge system comprising:

positioning a bridge laying vehicle at a bridge location;

extending a vehicle support for the bridge laying vehicle;

pivoting a lifting frame, carrying first and second articulatedly interconnected bridge parts, from a lowered transportation position on the bridge laying vehicle to a raised laying position;

drawing up a laying cable connected to the second bridge part to cause the second bridge part to assume a position aligned with the first bridge part;

unlocking the first bridge part from the lifting frame;

deploying the laying cable to cause the first and second bridge parts to be lowered, with a first end of the first bridge part pivoting relative to a lower end of the lifting frame;

extending a plurality of trestle legs from a free end portion of the second bridge part;

continuing to lower the first and second bridge parts to cause the second bridge part to be supported by the plurality of trestle legs;

lowering a portion of the lifting frame attached to the first end of the first bridge part until the first end of the first bridge part achieves a supporting position; and releasing the first end of the first bridge part from the lifting frame.

7. The method of claim 6, wherein the lifting frame is pivoted more than 90° from the lowered transportation position to the raised laying position.

8. The method of claim 6, wherein the supporting position for the first bridge part is achieved when the first end of the first bridge part is connected to a trestle leg bracing tube of a previously laid bridge section.

9. The method of claim 6, further comprising: guiding the laying cable through a lowering frame carried by the lifting frame.

10. The method of claim 9, further comprising: extending the lowering frame relative to the lifting frame in causing the second bridge pad to assume the position aligned with the first bridge part.

* * * * *